US007669265B2

(12) United States Patent
Weise

(10) Patent No.: US 7,669,265 B2
(45) Date of Patent: Mar. 2, 2010

(54) BUCKWHEAT HULL PILLOW

(76) Inventor: Mary Jane Weise, 58709 Fox Bow Dr., Elkhart, IN (US) 46516

( * ) Notice: Subject to any disclaimer, the term of this patent is extended or adjusted under 35 U.S.C. 154(b) by 0 days.

(21) Appl. No.: 12/277,536

(22) Filed: Nov. 25, 2008

(65) Prior Publication Data

US 2009/0133193 A1 May 28, 2009

Related U.S. Application Data

(60) Provisional application No. 60/990,023, filed on Nov. 26, 2007.

(51) Int. Cl.
*A47G 9/00* (2006.01)

(52) U.S. Cl. ..... 5/640; 5/636; 5/644; 5/949; 5/952; 297/393

(58) Field of Classification Search ..... 5/640, 5/636, 645, 638, 655, 644, 949, 952; 297/393, 297/391

See application file for complete search history.

(56) References Cited

U.S. PATENT DOCUMENTS

| | | | | | |
|---|---|---|---|---|---|
| 2,336,707 | A * | 12/1943 | Thompson | ..... | 5/636 |
| 4,617,691 | A * | 10/1986 | Monti et al. | ..... | 5/640 |
| 5,682,632 | A * | 11/1997 | Cotroneo | ..... | 5/636 |
| 7,120,953 | B2 * | 10/2006 | Ferber et al. | ..... | 5/636 |
| 7,146,665 | B1 * | 12/2006 | Moorin | ..... | 5/644 |
| 7,213,883 | B2 * | 5/2007 | Charnitski | ..... | 297/391 |

* cited by examiner

*Primary Examiner*—Alexander Grosz
(74) *Attorney, Agent, or Firm*—Emerson, Thomson & Bennett; Roger D. Emerson; Nathan B. Webb

(57) ABSTRACT

Some embodiments of the present invention generally relate to pillow devices comprising a pair of opposing lobe cushions connected by a cross member comprising a neck supporting cushion. In some embodiments the cushions may define a region for receiving a back portion of a human head in a cradling relation. Furthermore, according to some embodiments the cradle region can optionally be adjustable by the user.

17 Claims, 3 Drawing Sheets

BUCKWHEAT HULL PILLOW

I. CROSS REFERENCE TO RELATED APPLICATIONS

The present application claims priority to U.S. Provisional Patent Application No. 60/990,023 filed Nov. 26, 2007 now pending, which is incorporated herein by reference in its entirety.

II. BACKGROUND OF THE INVENTION

A. Field of Invention

This invention generally relates to pillow devices for use by humans. The present invention also generally relates to methods for making and using such pillow devices.

B. Description of the Related Art

It is well known in the art to use cushions to support a person's head. One such cushion is an ordinary rectangular pillow. Such pillows work fine when the user is in a lying or reclined posture. However, the rectangular pillow does not readily remain in place when the user is in a seated or otherwise upright posture. More specifically, rectangular pillows lack any sort of structure that is adapted to mate with the head and shoulders of the user in a generally fixed relation to prevent movement. Although ordinary pillows can generally be shaped by the user by redistributing the stuffing material, they lack any fixed mating structure and therefore can readily lose their desired shape and shift. Some attempts to address this deficiency have included shaped pillows that fit around the neck. While this can be effective in supporting the head by limiting the lateral range of motion of the neck, this design can still allow the head to shift from side to side to an undesirable degree.

Accordingly, there is a gap in the art where no structure is provided to support the head by cradling the back of the head with a shaped pillow, thereby limiting the lateral range of motion of the neck.

III. SUMMARY OF THE INVENTION

Some embodiments generally relate to a pillow, comprising: a first lobe cushion defining a generally elongate shape, the first lobe cushion having an inward-facing portion and an outward-facing portion in a parallel relation to the inward-facing portion; a second lobe cushion defining a generally elongate shape, the second lobe cushion having an inward-facing portion and an outward-facing portion in a parallel relation to the inward-facing portion, and the second lobe cushion being in a generally parallel relation to the first lobe, wherein the inward-facing portion of the first lobe cushion faces the inward-facing portion of the second lobe cushion; and a neck support cushion connecting the first lobe cushion and second lobe cushion, the neck cushion having a top portion adjacent to the inward-facing portions of the first and second lobe cushions, and wherein the top portion of the neck support cushion, the inward-facing portion of the first lobe cushion, and the inward-facing portion of the second lobe cushion together define an opening for receiving a back portion of a human head.

Other benefits and advantages will become apparent to those skilled in the art to which it pertains upon reading and understanding of the following detailed specification.

IV. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

V. DETAILED DESCRIPTION OF THE INVENTION

Figure 1:
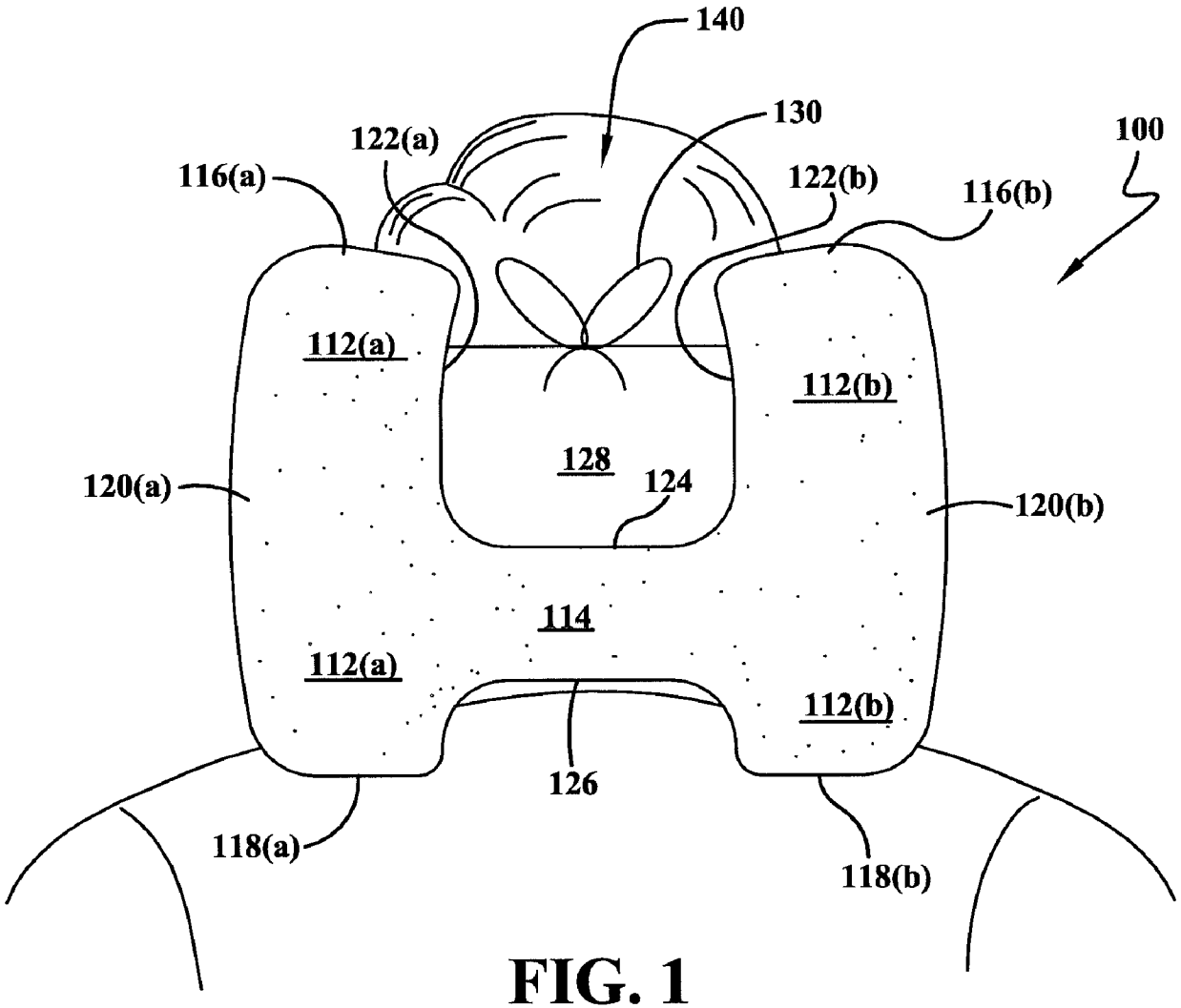
FIG. 1 is a drawing of an embodiment in use.

The present invention generally relates to head support pillow devices and related methods. Embodiments can include a first generally elongate lobe cushion and a second generally elongate lobe cushion disposed in a generally parallel relation to the first lobe cushion. Furthermore, the first and second lobe cushions can be connected by a neck support cushion. Some embodiments can optionally include a tethering member for mechanically linking portions of the lobe cushions. Some embodiments can comprise a pillow adapted to adjustably cradle the head while the user is in a seated or upright position.

A first lobe cushion can comprise a generally elongate shape having an inward-facing portion and an outward-facing portion arranged in a generally parallel relation to a longitudinal axis. In some embodiments at least the inward-facing portion can define a surface that curves in a generally inward direction. In other embodiments the inward-facing portion can define a generally straight surface. The first lobe cushion can further comprise a top portion and a bottom portions disposed at opposing ends of the longitudinal axis. According to some embodiments the cushion can have front and back faces spaced apart to define a thickness.

A second lobe cushion can comprise a generally elongate shape having an inward-facing portion and an outward-facing portion arranged in a generally parallel relation to a longitudinal axis. In some embodiments at least the inward-facing portion can define a surface that curves in a generally inward direction. Accordingly, the combination of the inward-facing portions of the first and second lobe cushions can define a generally rounded cradle for receiving a back portion of a human head in a supportive relation. In other embodiments the inward-facing portion can define a generally straight surface, thus forming a generally less rounded cradle in combination with that of the first lobe cushion. The second lobe cushion can further comprise a top portion and a bottom portion disposed at opposing ends of the longitudinal axis. According to some embodiments the cushion can have front and back faces spaced apart to define a thickness. According to some embodiments, a second lobe cushion can comprise a mirror image of the first lobe cushion.

A neck support cushion can comprise a cross member running between the first and second lobe cushions and connecting them. The neck support cushion can comprise a top portion adjacent to the inward-facing portions of the lobe cushions. The neck support cushion can further comprise a bottom portion facing generally away from the top portion and in a generally parallel relation therewith. The top and bottom portions can run generally parallel with a longitudinal axis that is generally perpendicular to that of the lobe cushions. Furthermore, in some embodiments the neck support cushion connects to the lobe cushions at a portion away from either end of the lobe cushion. Accordingly, the combination of the lobe cushions connected by the neck support cushion defines a generally H-shaped pillow having an opening adapted to receive a back portion of a human head in a cradling relation.

According to some embodiments the first lobe cushion, the second lobe cushion and the neck support cushion together define different regions of the same cushion. In other embodiments the first lobe cushion, the second lobe cushion and the neck support cushion can comprise independent parts that are assembled to form a pillow device. In still other embodiments the first lobe cushion, second lobe cushion and neck support cushion comprise independent parts that are assembled to form a continuous volume into which a cushioning portion can be placed.

According to some embodiments a pillow device can define a bag device defining an interior volume adapted to contain an inner cushioning portion. One of skill in the art will recognize that a wide variety of materials can be suitable bag materials. Some materials include, without limitation, one or more of natural fiber cloth, synthetic fiber cloth, animal hide, fleece, an air-impermeable material, or any combination thereof. According to some embodiments, natural fiber cloth can comprise, without limitation, one or more of cotton, wool, alpaca, angora, camel hair, cashmere, catgut, chiengora, llama, mohair, silk, bamboo, coir, flax, hemp, jute, kenaf, manila, piña, raffia, ramie, sisal, or any combination thereof. Further, according to some embodiments synthetic fiber cloth can comprise, without limitation, one or more of polyester, nylon, rayon, acetate, modacrylic, polylactic acid, olefin, chlorinated olefin, or any combination thereof. Still further, according to some embodiments animal hide can comprise, without limitation, one or more of cow hide, deer hide, or any combination thereof. According to still other embodiments, an air-impermeable material can comprise, without limitation, vinyl, latex, nitrile rubber, acrylic or any combination thereof.

According to some embodiments a pillow device can comprise an inner cushioning portion. One of skill in the art will recognize that a wide variety of materials can comprise suitable cushioning portions. Some suitable cushioning materials include, without limitation, one or more of buckwheat hulls, rice, flaxseed, corn, polymer foam, polymer foam beads, memory foam, nonwoven fibers, or any combination thereof. Furthermore, according to some embodiments nonwoven fibers can comprise, without limitation, one or more of cotton, wool, alpaca, angora, camel hair, cashmere, catgut, chiengora, llama, mohair, silk, bamboo, coir, flax, hemp, jute, kenaf, manila, piña, raffia, ramie, sisal, polyester, nylon, rayon, acetate, modacrylic, polylactic acid, olefin, chlorinated olefin, or any combination thereof. In some embodiments the thickness of a cushion, such as the neck support cushion, can be adjusted by moving the inner cushioning portion toward or away from the center of the cushion.

Some embodiments can optionally include a tethering member running from a top portion of the first lobe cushion to a top portion of the second lobe cushion. For example, some embodiment include a single tethering member attaching at one end to a top portion of the first lobe cushion and at the other end to a top portion of the second lobe cushion. Other embodiments include a first tethering member attached at one end to a top portion of the first lobe cushion, and a second tethering member attached to a top region of the second lobe cushion. A suitable tether can comprise any of a wide variety of materials including, without limitation, one or more of rope, cord, elastic band, hook and loop fastener, strap, or any combination thereof. Furthermore, tethering members can be joined according to any of a wide variety of known methods or devices including, without limitation, one or more of a buckle, a clasp, a snap, a button or any combination thereof. Still further, according to some embodiments the cradling portion of the pillow device can be adjusted as to size by adjusting the length of the tether.

According to some embodiments a seam of one or more of the foregoing lobe cushions and/or neck support cushion can be formed so that the edges of the material comprising the bag extend generally outward away from the seam. In other embodiments a seam of one or more of the foregoing lobe and/or neck support cushions can be form so that the edges of the material comprising the bag extend generally inward away from the seam. For instance, one way of fabricating such embodiments is to form a seam along all but a portion of a perimeter, and then pull the bag through the portion lacking a seam thus turning the bag inside out. Accordingly the edges of the fabric forming the bag extend generally inward away from the seam. Some embodiments include a combination of seam types. Furthermore, in some embodiments a seam can include one or more zipper structures for reversibly opening the bag device.

Referring now to the drawings wherein the showings are for purposes of illustrating embodiments of the invention only and not for purposes of limiting the same, FIG. 1 is a rearward perspective view of an embodiment in use. A first lobe cushion 112(*a*) and a second lobe cushion 112(*b*) define generally elongate structures having an inward-facing portion 122(*a*), 122(*b*) and an outward facing portion 120(*a*), 120(*b*), a top portion 116(*a*), 116(*b*) and a bottom portion 118(*a*), 118(*b*). The lobe cushions 112(*a*), 112(*b*) are connected by a neck support cushion 114, which is continuous with the lobe cushions 112(*a*), 112(*b*). Accordingly, the lobe cushions 112(*a*), 112(*b*) and the neck support cushion 114 define different regions of a single cushion 100. Further according to FIG. 1, the neck support cushion 114 defines a top portion 124 and a bottom portion 126. The top portion 124 is continuous with the inward-facing portions 122(*a*), 122(*b*) of the first and second lobe cushions 112(*a*), 112(*b*), and the combination defines a cradling region 128 for receiving a back portion of a human head 140. A tether 130 is included in the form of a tie 130. The tie 130 comprises two parts, each being fixed at one end to top portion of a lobe cushion 116(*a*), 116(*b*). According to the embodiment in FIG. 1, the size of the cradle region 128 can be adjusted by drawing or slackening the tether 130 and tying the tether 130 to lock in the desired degree of drawing or slackening.

Figure 2A:
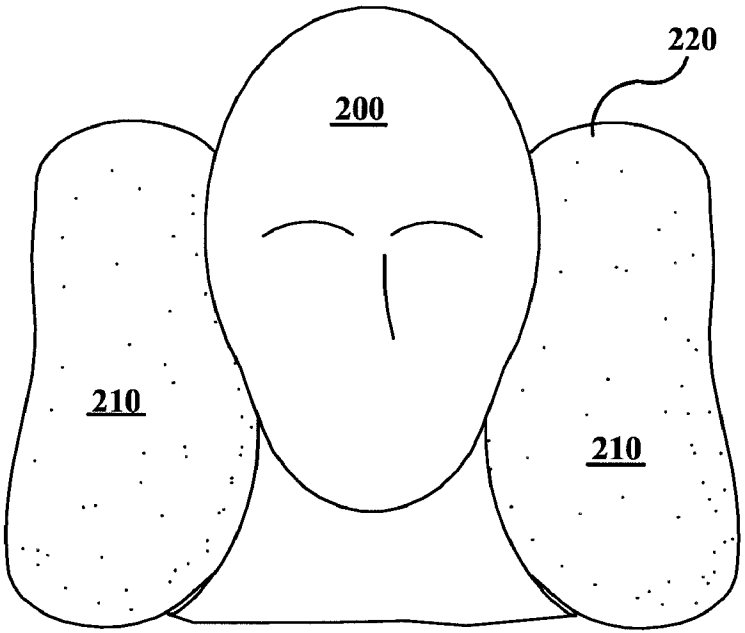
FIG. 2A is a front perspective drawing of a head engaging an embodiment.
Figure 2B:
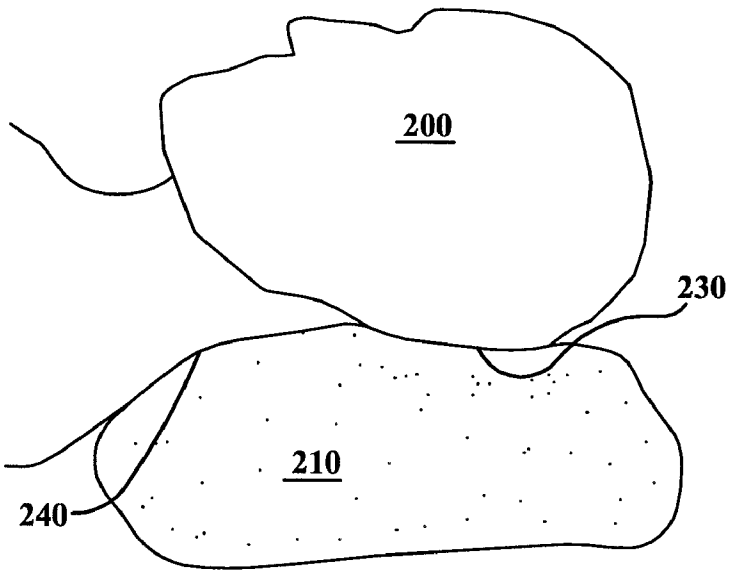
FIG. 2B is a side perspective drawing of a head engaging an embodiment.

FIGS. 2A and 2B show alternative views of a head 200 being cradled by an embodiment 220. As shown in FIG. 2A the head 200 is generally centered over the cradle region of the embodiment 220, and a lobe cushion 210 is disposed generally to either side of the head 220. FIG. 2B shows a side view of the same embodiment 220, wherein the head 200 is supported by the cradling region 230 and the neck is supported by the neck support cushion 240. According to this embodiment, the pillow device can be useful in a seated, upright, reclined and/or lying posture.

Figure 3:
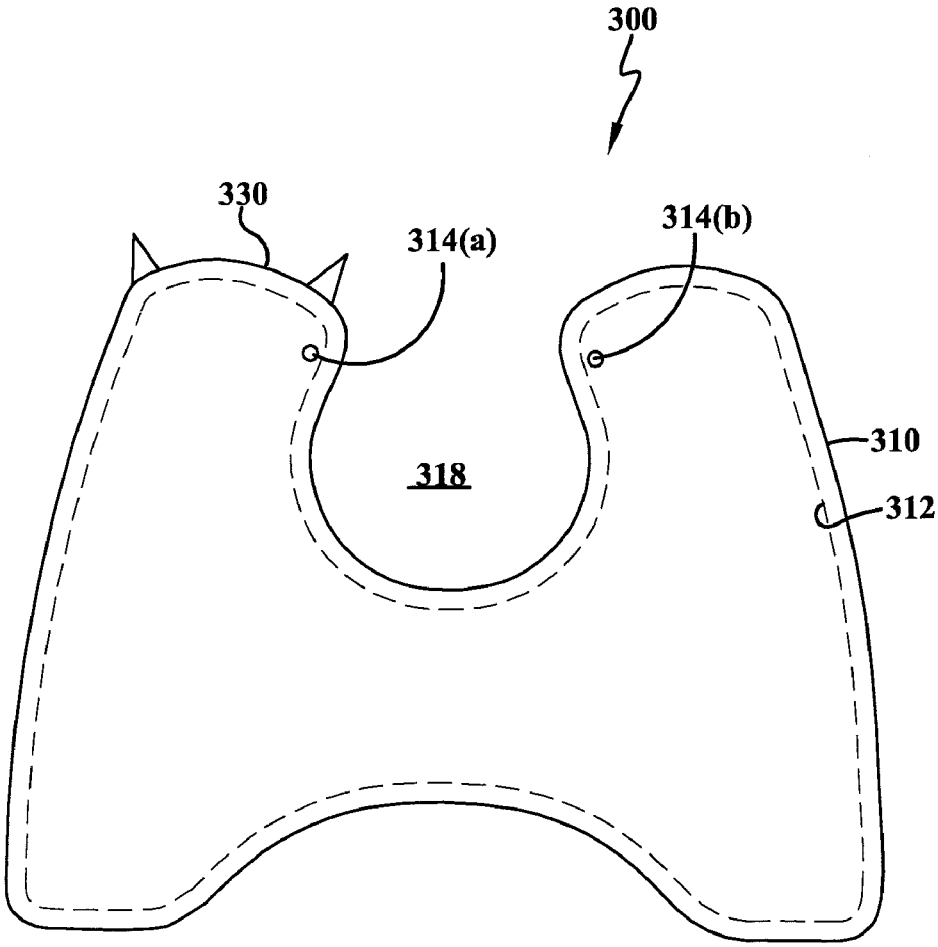
FIG. 3 is a plan view drawing of a pattern according to an embodiment.

FIG. 3 shows a plan view of a pattern 300 for making an embodiment. The pattern includes a perimeter 310, and a seam 312 spaced apart from and generally following the perimeter 310. The perimeter further defines a generally curved region 318, which will form a cradle region in the finished product. The pattern 300 further comprises a pair of opposing opening 314(*a*), 314(*b*) for receiving a tether member (not shown). The pattern further includes a region 330 for forming a fill hole (not shown). According to some embodiments, a pair of cutouts can be made from the pattern 300 and sewn, fused or otherwise joined together along the seam 312 to form a bag structure, except that the region 330 is left open thereby forming a fill hole. The assembly can then be turned inside out through the fill hole so that the extra material extending from the seam 312 is inside the bag structure. Cushioning material can then be added through the fill hole, and the fill hole can be subsequently sewn shut or otherwise joined. For instance, in some embodiments the edges of the region 330 are tucked into the interior of the bag structure and the fill hole is then sewn shut in a manner that substantially visually matches the rest of the seam 312.

The embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

Having thus described the invention, it is now claimed:

I claim:

1. A pillow, comprising:

a first lobe cushion defining a generally elongate shape, the first lobe cushion having:

an inward-facing portion and an outward-facing portion in a parallel relation to the inward-facing portion; and a bottom portion;

a second lobe cushion defining a generally elongate shape, the second lobe cushion having:

an inward-facing portion and an outward-facing portion in a parallel relation to the inward-facing portion, and the second lobe cushion being in a generally parallel relation to the first lobe, wherein the inward-facing portion of the first lobe cushion faces the inward-facing portion of the second lobe cushion; and a bottom portion; and a neck support cushion connecting the first lobe cushion and second lobe cushion, the neck cushion having:

a top portion adjacent to the inward-facing portions of the first and second lobe cushions, and wherein the top portion of the neck support cushion, the inward-facing portion of the first lobe cushion, and the inward-facing portion of the second lobe cushion together define an opening for receiving a back portion of a human head;

a bottom portion, wherein the bottom portion of the first lobe cushion and the bottom portion of the second lobe cushion extend beyond the bottom portion of the neck support cushion;

wherein the first lobe cushion, second lobe cushion, and neck support cushion comprise different regions of a single substantially planar cushion, and the single substantially planar cushion comprises an outer bag portion, and an inner cushioning portion comprised of a solid material, and means to adjustably connect the first and second lobe cushions to each other.

2. The pillow of claim 1, wherein the outer bag portion comprises one or more of a natural fiber cloth, synthetic fiber cloth, animal hide, fleece, an air-impermeable material, or any combination thereof.

3. The pillow of claim 2, wherein the natural fiber cloth comprises one or more of cotton, wool, alpaca, angora, camel hair, cashmere, catgut, chiengora, llama, mohair, silk, bamboo, coir, flax, hemp, jute, kenaf, manila, piña, raffia, ramie, sisal, or any combination thereof.

4. The pillow of claim 2, wherein the synthetic fiber cloth comprises one or more of polyester, nylon, rayon, acetate, modacrylic, polylactic acid, olefin, chlorinated olefin, or any combination thereof.

5. The pillow of claim 2, wherein the animal hide comprises one or more of cow hide, deer hide, or any combination thereof.

6. The pillow of claim 2, wherein the air-impermeable material comprises vinyl, latex, nitrile rubber, acrylic or any combination thereof.

7. The pillow of claim 1, wherein the neck support cushion has a selectively adjustable thickness when the inner cushioning portion is adjusted toward or away from the center of the neck support cushion.

8. The pillow of claim 1, comprising a tether running from a top portion of the first lobe cushion to a top portion of the second lobe cushion.

9. The pillow of claim 8, wherein the tether comprises a tether attached at one end to the first lobe cushion, and a second tether attached at one end to the second lobe cushion.

10. The pillow of claim 9, wherein the first and second tethers comprise one or more of a rope, a cord, an elastic band, a hook and loop fastener, a strap, or any combination thereof.

11. The pillow of claim 9, wherein the tether further comprises one or more of a buckle, a clasp, a snap, a button or any combination thereof.

12. The pillow of claim 9, wherein fixing the tether sets the size of the opening.

13. The pillow of claim 12, wherein the first and second lobe cushions can be drawn closer together by tightening the tether, and wherein the lobe cushions can be spaced farther apart by loosening the tether.

14. The pillow of claim 1, wherein the arrangement of the first lobe cushion, second lobe cushion, and neck support cushion generally define a pillow having the shape of the capital letter "H".

15. The pillow of claim 1, wherein the inner cushioning portion comprises buckwheat hulls.

16. A method for properly positioning a pillow, comprising the steps of:

(A) providing a substantially planar pillow, comprising: (1) a first lobe cushion defining a generally elongate shape, the first lobe cushion having an inward-facing portion and an outward-facing portion in a parallel relation to the inward-facing portion, and a bottom portion; (2) a second lobe cushion defining a generally elongate shape, the second lobe cushion having an inward-facing portion and an outward-facing portion in a parallel relation to the inward-facing portion, and the second lobe cushion being in a generally parallel relation to the first lobe, wherein the inward-facing portion of the first lobe cushion faces the inward-facing portion of the second lobe cushion, and a bottom portion; (3) a neck support cushion connecting the first lobe cushion and second lobe cushion, the neck cushion having a top portion adjacent to the inward-facing portions of the first and second lobe cushions, and wherein the top portion of the neck support cushion, the inward-facing portion of the first lobe cushion, and the inward-facing portion of the second lobe cushion together define an opening for receiving a back portion of a human head, and a bottom portion; and (4) a tether attached at one end to the inward-facing portion of the first lobe cushion, and a second tether attached at one end to the inward-facing portion the second lobe cushion; wherein (a) the first lobe cushion, second lobe cushion, and neck support cushion comprise different regions of a single substantially planar cushion; (b) the bottom portion of the first lobe cushion and the bottom portion of the second lobe cushion extend beyond the bottom portion of the neck support cushion; (c) the inward-facing portions of the first and second lobe cushions together define an opening for receiving a back portion of a user's head; and (d) fixing the tether sets the size of the opening for receiving the user's head;

(B) positioning said substantially planar pillow on the back of a user's head by: (1) positioning the pillow in a location behind the user's head and substantially parallel to the user's body, (2) resting the bottom portion of the first lobe cushion and the bottom portion of the second lobe cushion on the top of a user's shoulders, and (3) resting the neck cushion portion on a user's neck; wherein the bottom portions of the first and second lobe cushions operatively position and secure the neck cushion portion at an optimal location user's neck.

17. The method of claim 16, wherein step (B)(1) additionally comprises:

adjusting the size of the opening for receiving the user's head by fixing the tether at a position that corresponds with the user's desired opening size, prior to positioning the pillow in a location behind the user's head and substantially parallel to the user's body.

* * * * *